US009267419B2

(12) United States Patent
Mehravaran et al.

(10) Patent No.: US 9,267,419 B2
(45) Date of Patent: Feb. 23, 2016

(54) CONVEX FAN SHROUD

(71) Applicant: Ford Global Technologies, LLC, Dearborn, MI (US)

(72) Inventors: Meisam Mehravaran, Oak Park, MI (US); Garrett Michael O'Donohue, Livonia, MI (US); Jim Tyler, Livonia, MI (US); LaMar Stewart, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/217,918

(22) Filed: Mar. 18, 2014

(65) Prior Publication Data

US 2015/0267600 A1 Sep. 24, 2015

(51) Int. Cl.

| | |
|---|---|
| ***F01P 7/02*** | (2006.01) |
| ***F01P 1/02*** | (2006.01) |
| *F01P 7/04* | (2006.01) |
| *F01P 5/04* | (2006.01) |
| *F01P 7/08* | (2006.01) |
| *F01P 5/12* | (2006.01) |

(52) U.S. Cl.

CPC ... *F01P 1/02* (2013.01); *F01P 5/04* (2013.01); *F01P 5/12* (2013.01); *F01P 7/046* (2013.01); *F01P 7/084* (2013.01); *F01P 2025/66* (2013.01)

(58) Field of Classification Search

CPC ..... F01P 5/04; F01P 7/046; F01P 7/084; F01P 2025/66; F01P 5/12

USPC ..... 123/41.11

See application file for complete search history.

(56) References Cited

U.S. PATENT DOCUMENTS

| | | | | |
|---|---|---|---|---|
| 5,724,925 | A * | 3/1998 | Ito | 123/41.49 |
| 6,070,560 | A * | 6/2000 | Johnston et al. | 123/41.11 |
| 7,918,194 | B2 * | 4/2011 | Kojima | 123/41.11 |
| 2008/0196678 | A1 | 8/2008 | Kakishita et al. | |

FOREIGN PATENT DOCUMENTS

EP 108479 A1 * 5/1984

* cited by examiner

*Primary Examiner* — Lindsay Low
*Assistant Examiner* — Charles Brauch
(74) *Attorney, Agent, or Firm* — LeClairRyan

(57) ABSTRACT

A convex fan shroud for use with an automotive engine cooling system having a fan and a fan-cooled, liquid-to-air radiator is disclosed. The convex fan shroud has an optimized shape that leads to high air flow rates through the radiator. The convex fan shroud includes a front frame that defines an air-intake opening, a convex top wall connected to the frame, a convex bottom wall connected to the frame, and a pair of opposed convex side walls connected to the frame and to the top and bottom walls. The interior surfaces of the walls are smooth. The convex walls define a barrel-shaped shroud body that includes a round engine-facing opening to accommodate the fan. In addition to generating a higher flow rate, the disclosed inventive concept for a smooth convex fan shroud is relatively low cost to produce and has a relatively high degree of rigidity.

15 Claims, 6 Drawing Sheets

CONVEX FAN SHROUD

TECHNICAL FIELD

The disclosed inventive concept relates generally to enhanced air cooling constructions for internal combustion engines. More particularly, the disclosed inventive concept is directed to a convex fan shroud having an optimum shape that leads to high air flow rates through the radiator and improved system efficiency without the need for additional engine input power.

BACKGROUND OF THE INVENTION

The conventional liquid-cooled internal combustion engine relies primarily on axial flow fans to draw cooling air from outside of the vehicle through the liquid-to-air heat exchanger or radiator for cooling. Various efforts have been made to improve cooling, including increasing the liquid capacity of the radiator, increasing the size or number of fan blades, and changing the pitch of the fan blades.

Complicating the challenge of efficiently cooling the liquid-cooled internal combustion engine is the fact that engine undergoes air flow and temperature changes during operation. When the vehicle is moving, particularly at highway speed, air cooling is elevated and the coolant temperature is lowered. However, when the vehicle is operating in stop-and-go conditions or when the vehicle is standing still, the effectiveness of air cooling drops considerably because the volume of air passing through the radiator is diminished.

In some instances vehicle designers have introduced fan shrouds to assure that there is sufficient cooling air passing through the radiator to reduce the temperature of the radiator coolant to thereby improve cooling efficiency in idle or near-idle conditions. A shroud directed to this purpose is intended to improve the air suction generated by the fan.

The shapes of known fan shrouds have traditionally been determined only by packaging demands that are themselves determined by increasingly restrictive engine compartments. Given such limitations and the lack of understanding about the dynamics of air flow, the influence of known shrouds on the airflow has been negligible.

As in so many areas of vehicle technology, there is always room for improvement related to the cooling arrangements for liquid-cooled internal combustion engines.

SUMMARY OF THE INVENTION

The disclosed inventive concept overcomes the problems associated with known efforts to improve the efficiency of cooling systems used in conjunction with internal combustion engines. Particularly, the effect of the fan shroud on overall airflow driven by a fan has been studied and an optimized shape for the shroud has been developed through, among other techniques, the use of 3D computational fluid dynamics (CFD) that generates accurate simulations of free-surface flows of fluids.

As a result, a shroud geometry having smooth convex walls was identified as being the optimum shape for a fan shroud for use with a liquid-cooled, internal combustion engine. The identified shroud shape generates higher flow rates under the most stressful of working conditions, that is, when the engine is at idle (or is at near-idle) with the air conditioner engaged or when the vehicle is towing a trailer.

The geometry of the convex shroud having smooth convex walls demonstrates that higher flow rates are generated. Smooth walls, free of grooves, angles or other surface features, are preferred as cavities and steps act as restrictions to the free flow of air and form vortexes. Beyond the smooth, restriction-free walls the convex shape of the shroud provides more internal space to breathe and move the cooling air.

Particularly, the disclosed inventive concept is a fan shroud for an automotive engine cooling system having a fan and a fan-cooled, liquid-to-air radiator. The convex fan shroud includes a front frame that defines an air-intake opening, a convex top wall connected to the frame, a convex bottom wall connected to the frame, and a pair of opposed convex side walls connected to the frame and to the top and bottom walls. The interior surfaces of the walls are smooth to minimize or eliminate air turbulence.

The convex walls define a barrel-shaped shroud body. The shroud body includes a round engine-facing opening in which the engine fan is generally disposed.

In addition to generating a higher flow rate, the disclosed inventive concept for a smooth convex fan shroud has a relatively low production cost and has a relatively high degree of rigidity.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
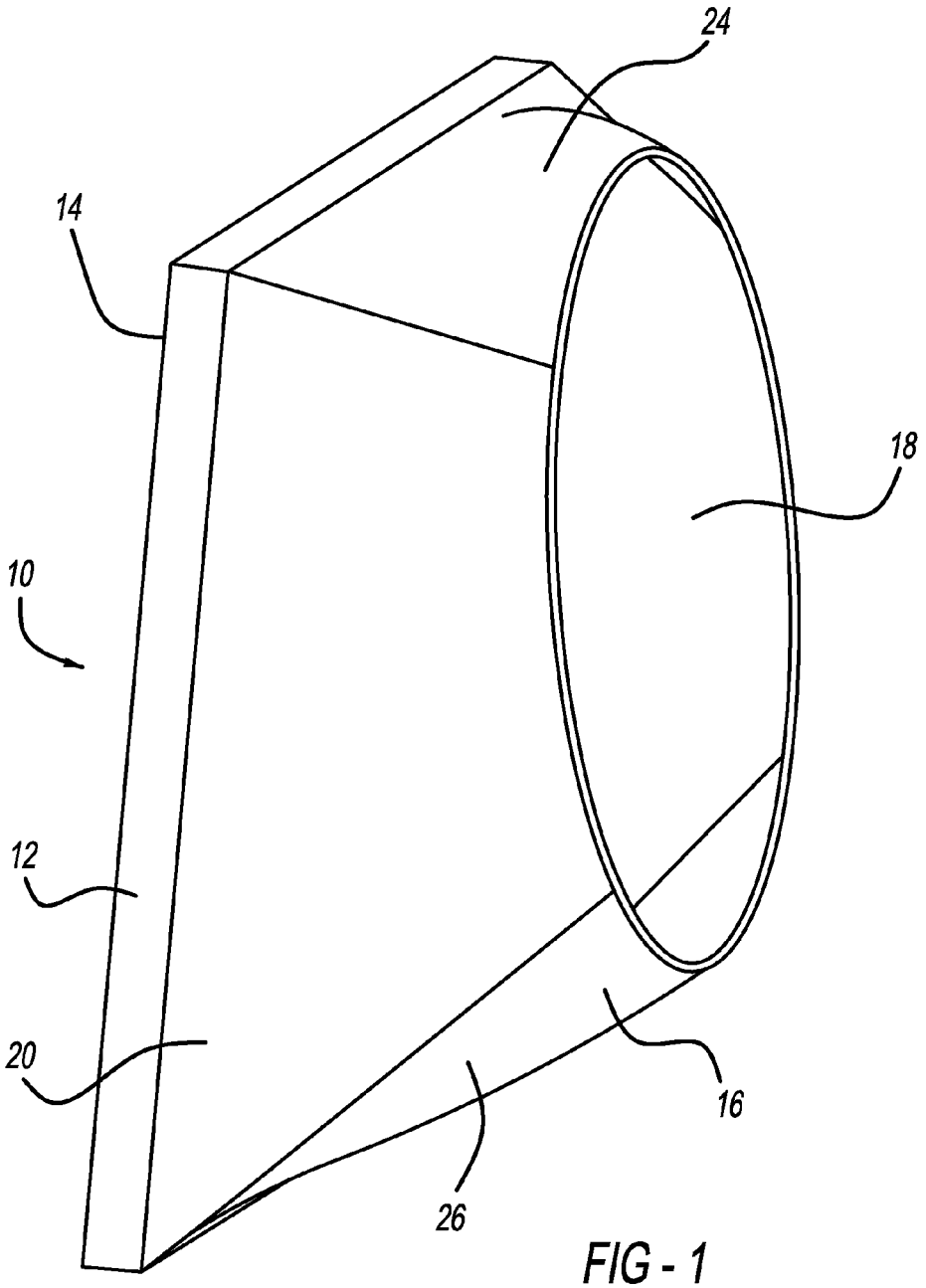
FIG. 1 illustrates a perspective side view of a convex fan shroud according to the disclosed inventive concept as generally viewed from a first side.

In the following figures, the same reference numerals will be used to refer to the same components. In the following description, various operating parameters and components are described for different constructed embodiments. These specific parameters and components are included as examples and are not meant to be limiting.

The disclosed inventive concept may find application in any number of vehicles, including automotive vehicles and trucks. The disclosed inventive concept may also find application in any system that utilizes a liquid-to-air heat exchanger or radiator in conjunction with a fan for cooling.

Figure 2:
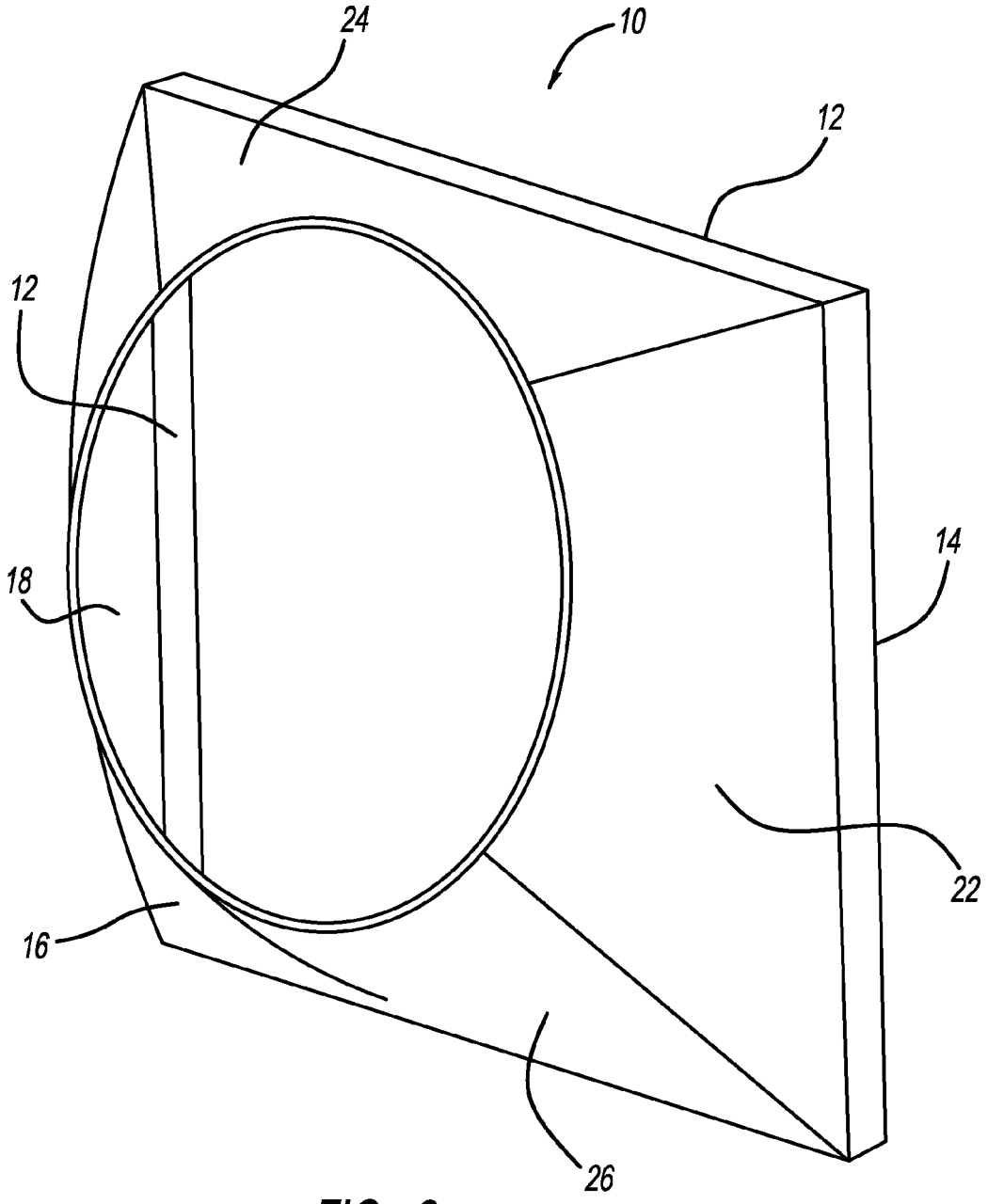
FIG. 2 illustrates a perspective side view of the convex fan shroud according to the disclosed inventive concept as generally viewed from a second side.

Referring to FIGS. 1 and 2, perspective side views of a convex fan shroud according to the disclosed inventive concept, generally illustrated as 10, are shown. The illustrated overall configuration of the convex fan shroud 10 is suggestive as alternative configurations, which may be, for example, longer, wider or taller, may be adopted as well while still falling within the spirit of the disclosed inventive concept. However, for reasons of cooling efficiency, the side walls are convex regardless of other changes to the overall configuration of the convex fan shroud 10.

The convex fan shroud 10 may be composed of any suitable material including, but not limited to, a metal or a polymerized material such as ABS plastic.

The convex fan shroud 10 includes a frame 12 that provides structural support for attachment of the convex fan shroud 10 to a vehicle structure. The frame 12 defines the shroud front opening 14.

The convex fan shroud 10 includes a shroud back 16 having a fan opening 18 formed therein. Formed between the shroud front opening 14 and the fan opening 18 is a first convex side wall 20, a second convex side wall 22, a convex top wall 24, and a convex bottom wall 26. The overall configuration of the convex fan shroud 10 as defined by the convex walls is of barrel that tapers from the shroud front opening 14 to the fan opening 18.

Figure 3:
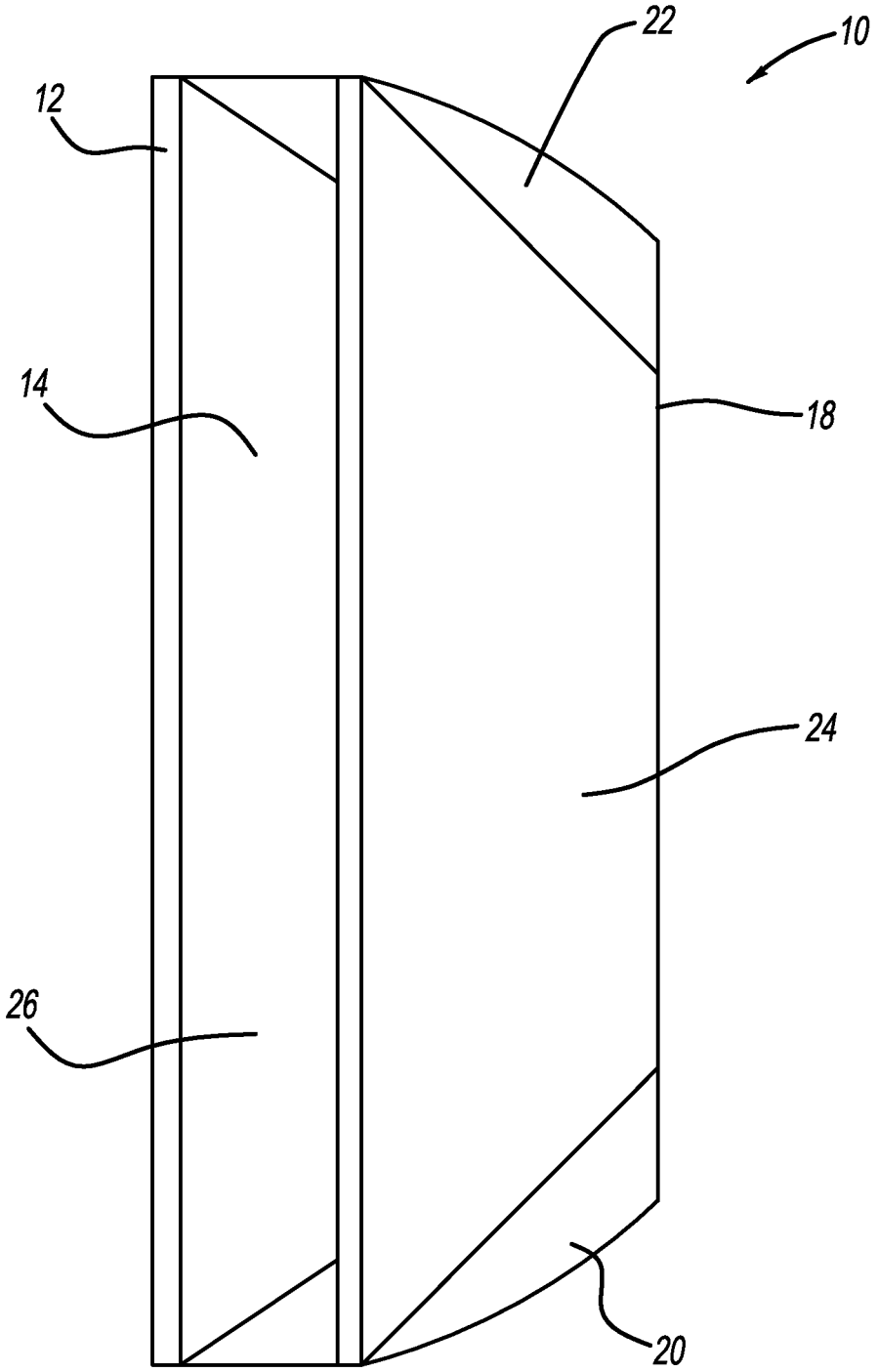
FIG. 3 illustrates a top view of the convex fan shroud according to the disclosed inventive concept.

FIG. 3 illustrates the convex fan shroud 10 of the disclosed inventive concept when viewed from the top. This view illustrates the shroud front opening 14 surrounded as it is by the frame 12. This view also illustrates the outwardly-bowed configurations of the first convex side wall 20 and the second convex side wall 22.

Figure 4:
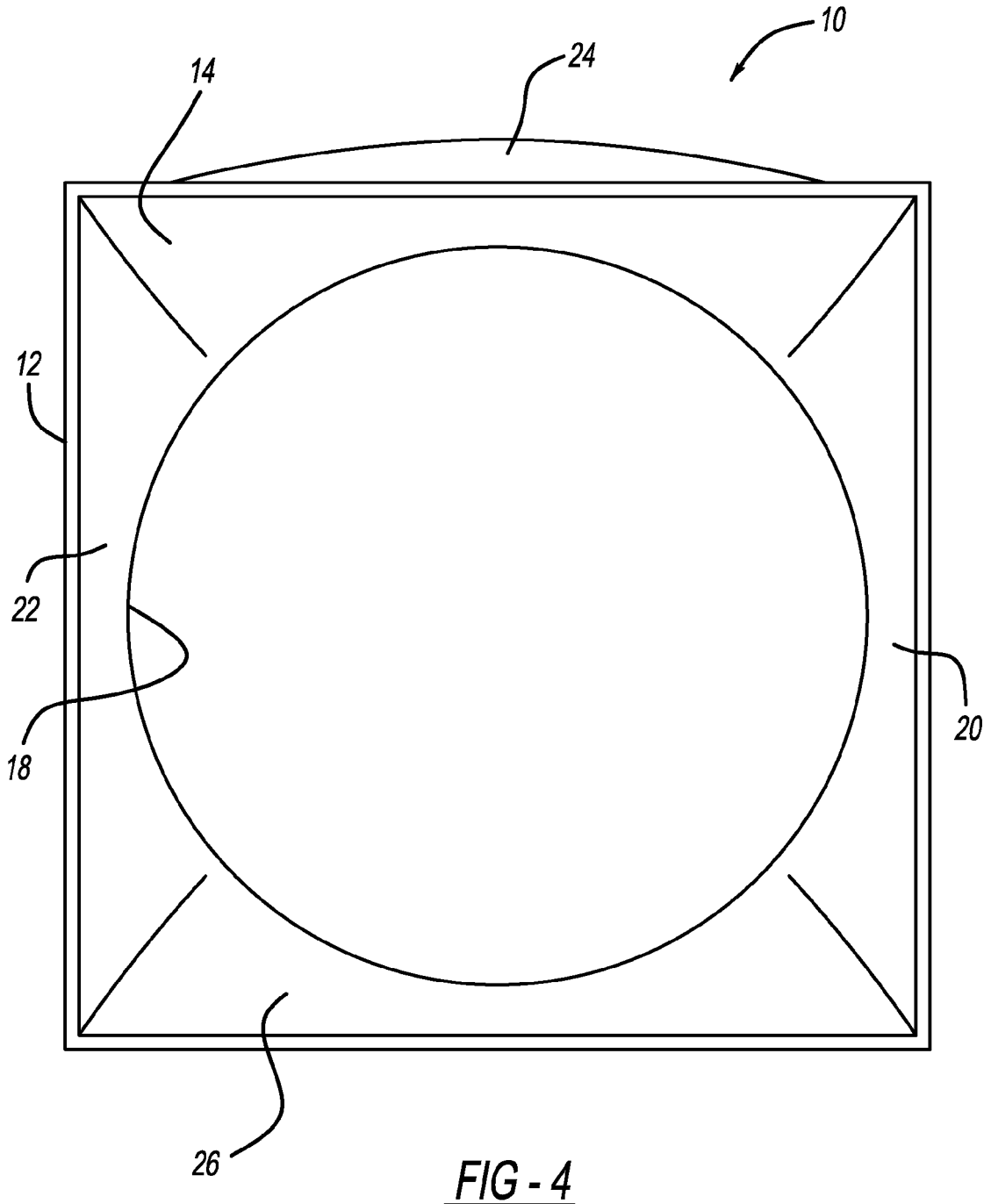
FIG. 4 illustrates an end view of the convex fan shroud of the disclosed inventive concept viewed from the air-intake or radiator-facing end.

FIG. 4 shows a front view of the convex fan shroud 10 as viewed from the shroud front opening 14. This view illustrates that the interior surfaces of the first convex side wall 20, the second convex side wall 22, the convex top wall 24, and the convex bottom wall 26 are smooth and are free of surface features that might restrict the free flow of cooling air passing thereover.

Figure 5:
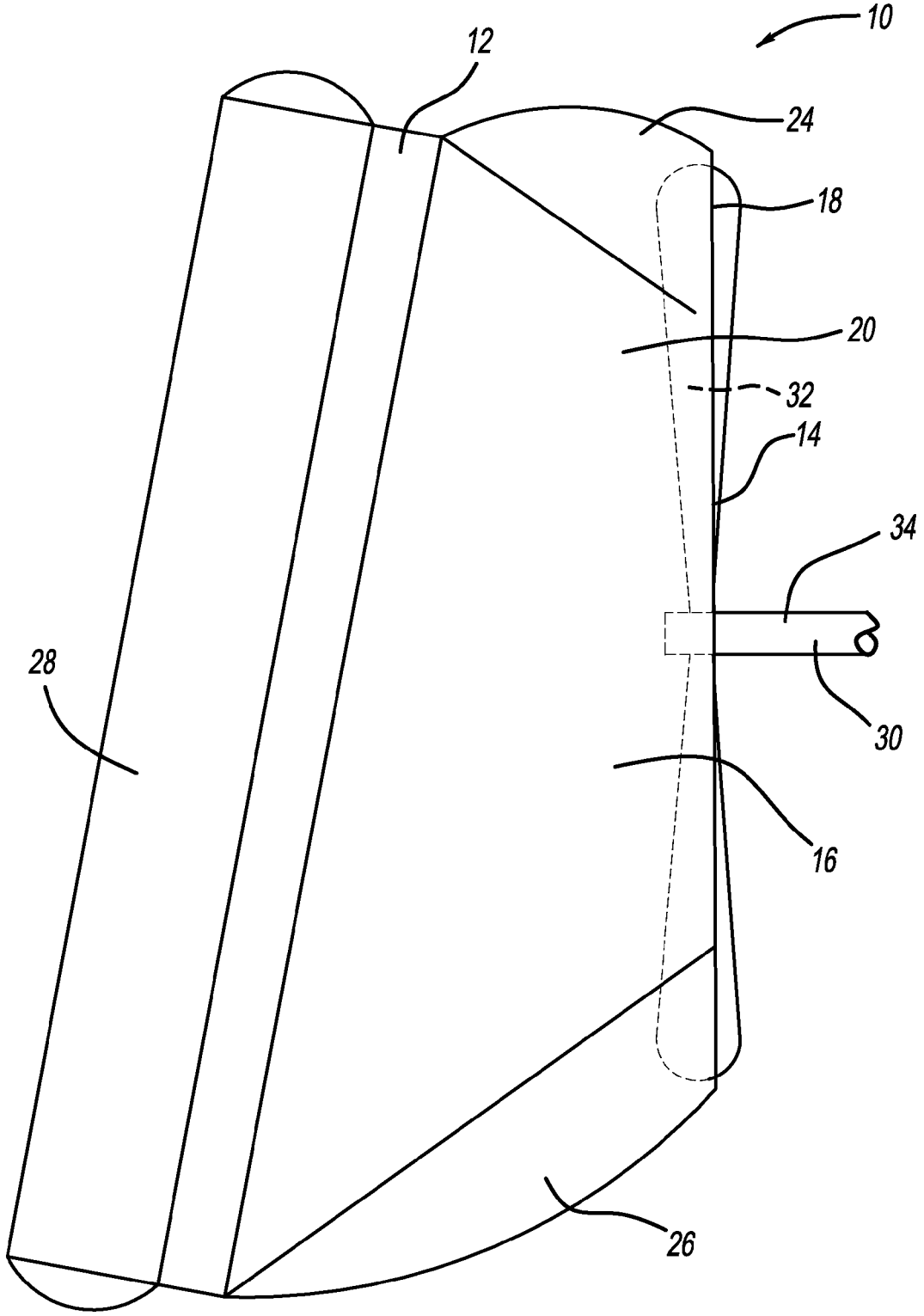
FIG. 5 illustrates a side view of the convex fan shroud according to the disclosed inventive concept showing the shroud in position relative to a liquid-to-air heat exchanger or radiator and a cooling fan assembly.

FIG. 5 illustrates a side view of the convex fan shroud 10 in position relative to a liquid-to-air heat exchanger or radiator 28 and a fan blade assembly 30 that includes a plurality of fan blades 32 (shown in broken lines) and a fan drive shaft 34. The configurations of both the radiator 28 and the fan blade assembly 30 are suggestive and are not intended as being limiting. The position of the fan blades 32 is such that areas of dead air are minimized or are eliminated entirely. To this end the clearance between the fan blades 32 and the inner surface of the convex fan shroud 10 should be minimized. However, due to the engine role and vibration issues which may lead to a collision, the clearance between the fan blades 32 and the inner surface of the convex fan shroud 10 usually cannot be lower than 20 mm.

Figure 6:
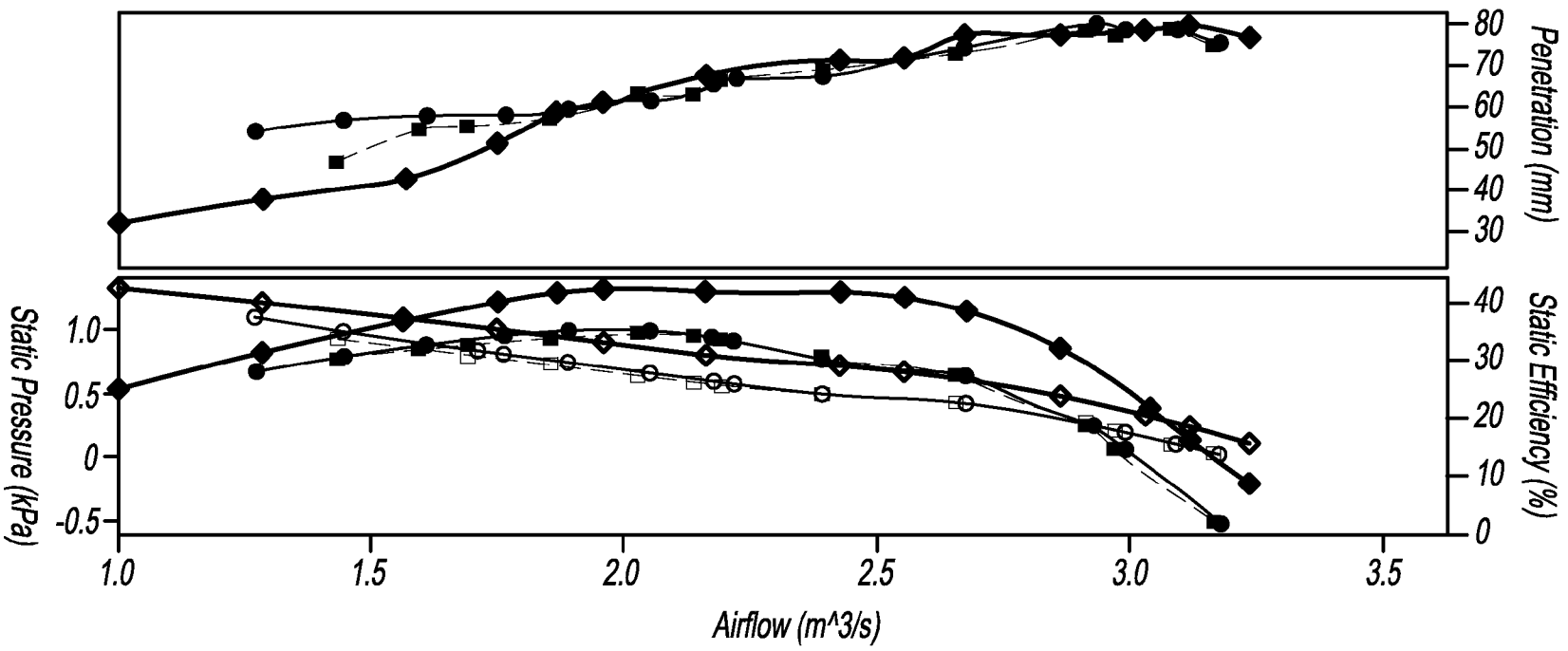
FIG. 6 is a graph illustrating air flow vs. pressure drop comparing current technologies against that of the disclosed inventive concept.

Test data provide evidence that the disclosed inventive concept provides improvements in the efficiency of cooling systems used in conjunction with internal combustion engines. Referring to FIG. 6, a graph is provided illustrating air flow vs. pressure drop comparing current technologies against that of the disclosed inventive concept. As the graph demonstrates, use of the improved shroud of the disclosed inventive concept leads to higher air flow rates.

For at least the above reasons the disclosed invention as set forth above overcomes the challenges faced by known air cooling systems for internal combustion engines. However, one skilled in the art will readily recognize from such discussion, and from the accompanying drawings and claims, that various changes, modifications and variations can be made therein without departing from the true spirit and fair scope of the invention as defined by the following claims.

What is claimed is:

1. A shroud for an automotive engine cooling system having a fan and a fan-cooled, liquid-to-air radiator, said shroud comprising:

an inside;

a front frame;

a fan opening;

a top wall connected to said frame;

a bottom wall connected to said frame;

a first side wall connected to said frame and said top and bottom walls; and a second side wall connected to said frame and said top and bottom walls, said walls being bowed outward relative to said inside between said frame and said opening, said outward bow of said walls defining a portion of a hyperbolic curve in cross-section, one end of said curve ending at said frame and the other end ending at said opening.

2. The shroud for an automotive engine cooling system of claim 1 wherein said front frame defines an air-intake opening.

3. The shroud for an automotive engine cooling system of claim 1 wherein said top wall, said bottom wall, said first side wall and said second side wall define a convex-shaped shroud body.

4. The shroud for an automotive engine cooling system of claim 1 wherein said engine-facing opening is substantially round.

5. The shroud of an automotive engine of cooling system claim 4 wherein the fan is disposed within said shroud body adjacent said engine-facing opening.

6. A shroud for an automotive engine cooling system having a fan and a fan-cooled, liquid-to-air radiator, said shroud comprising:

a front frame;

a shroud body attached to said front frame, said shroud body having an inside, an engine-facing opening, and walls extending from said front frame to said opening, said walls being bowed outward relative to said inside between said frame and said opening, said outward bow of said walls defining a portion of a hyperbolic curve in cross-section, one end of said curve ending at said frame and the other end ending at said opening.

7. The shroud for an automotive engine cooling system of claim 6 wherein said front frame defines an air-intake opening.

8. The shroud for an automotive engine cooling system of claim 6 wherein said walls include a top wall, a bottom wall, a first side wall, and a second side wall.

9. The shroud for an automotive engine cooling system of claim 7 wherein said engine-facing opening is substantially round.

10. The shroud of an automotive engine cooling system of claim 9 wherein the fan is disposed within said shroud body adjacent said engine-facing opening.

11. A method for increasing air movement through a liquid-to-air cooling radiator in a vehicle having an internal combustion engine and an engine-driven fan comprising the steps of:

forming a fan shroud having a front frame, an inside, an engine-facing opening and a shroud body attached to said frame, said body including walls extending from said frame to said opening, said walls being bowed outward relative to said inside, said outward bow of said walls defining a portion of a hyperbolic curve in cross-section, one end of said curve ending at said frame and the other end ending at said opening; and placing said shroud adjacent the radiator and at least partially encircling the fan.

12. The method for increasing air movement through a liquid-to-air radiator of claim 11 wherein said walls include a top wall, a bottom wall, a first side wall, and a second side wall.

13. The method for increasing air movement through a liquid-to-air radiator of claim 11 wherein said front frame defines an air-intake opening.

14. The method for increasing air movement through a liquid-to-air radiator of claim 11 wherein said engine-facing opening is substantially round.

15. The method for increasing air movement through a liquid-to-air radiator of claim 14 wherein the fan is disposed within said shroud body adjacent said engine-facing opening.

* * * * *